US005464158A

United States Patent [19]

Hofmann

[11] Patent Number: 5,464,158

[45] Date of Patent: Nov. 7, 1995

[54] FUEL INJECTION NOZZLE FOR INTERNAL COMBUSTION ENGINES

[75] Inventor: Karl Hofmann, Neckarrems, Germany

[73] Assignee: Robert Bosch GmbH, Stuttgart, Germany

[21] Appl. No.: 211,529

[22] PCT Filed: Jul. 29, 1993

[86] PCT No.: PCT/DE93/00669

§ 371 Date: May 2, 1994

§ 102(e) Date: May 2, 1994

[87] PCT Pub. No.: WO94/03720

PCT Pub. Date: Feb. 17, 1994

[30] Foreign Application Priority Data

Aug. 5, 1992 [DE] Germany ..... 42 25 805.7

[51] Int. Cl.[6] ..... F02M 45/08; F02M 61/16

[52] U.S. Cl. ..... 239/533.4; 239/533.5

[58] Field of Search ..... 239/533.2–533.12

[56] References Cited

U.S. PATENT DOCUMENTS 5,125,580 6/1992 Kronberger ..... 239/533.4

FOREIGN PATENT DOCUMENTS 240693 10/1987 European Pat. Off. ..... 239/533.5
4126698 10/1992 Germany .
2086473 5/1992 United Kingdom .

*Primary Examiner*—Karen B. Merritt
*Attorney, Agent, or Firm*—Edwin E. Greigg; Ronald E. Greigg

[57] ABSTRACT

A fuel injection nozzle for internal combustion engines for preinjection and main injection has an inwardly opening valve needle which is loaded by a single closing spring. After a prestroke ($h_v$), in which the supply pressure in combination with the effective surface area of the valve needle controls the stroke, a stroke switchover to an interposed piston takes place, the effective surface area of the piston is less than that of the valve needle. Because the force of the piston that tenses the closing spring is reduced proportionally compared with the force of the valve needle, a flatter opening of the valve needle takes place after the prestroke ($h_v$) than during the prestroke.

20 Claims, 2 Drawing Sheets

FUEL INJECTION NOZZLE FOR INTERNAL COMBUSTION ENGINES

BACKGROUND OF THE INVENTION

The invention relates to a fuel injection nozzle as defined hereinafter. Injection nozzles of this type, by controlling the stroke of the valve needle, have a preinjection and a main injection, in order to reduce the noise of combustion.

In an injection nozzle of this type, known from EP-A 240 683, the valve needle strikes the piston of the pressure transmitting device at the end of the prestroke, and this piston stops the further motion of the valve needle until the fuel pressure has risen far enough that its force exerted upon the valve needle in the opening direction exceeds the force of the closing spring and the force exerted by the piston. Although this known injection nozzle is small in structure, nevertheless the partition, because of the embodiment of the pressure chamber and its connecting conduit, suffers from being complicated to produce.

ADVANTAGES OF THE INVENTION

The fuel injection nozzle according to the invention has the advantage that to attain a graduated opening stroke of the closing needle as far as the piston, the same elements as in a single-spring holder are used; the piston is formed by means of special, but nevertheless easily achieved designing of the pressure bolt that transmits the closing force of the closing spring to the valve needle.

BRIEF DESCRIPTION OF THE DRAWINGS

Exemplary embodiments of the invention are shown in the drawing and described in detail below. Shown are FIG. 1, an injection nozzle in longitudinal section.

DESCRIPTION OF THE EXEMPLARY EMBODIMENTS

Figure 1:
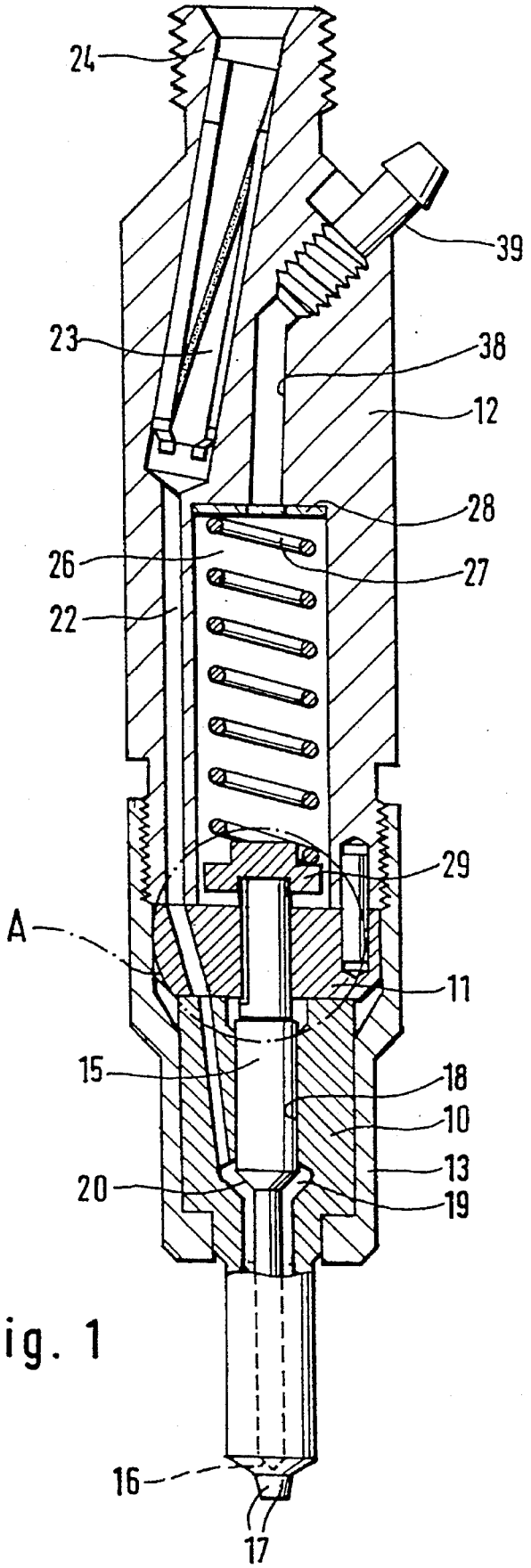

The injection nozzle has a nozzle body 10, which together with a shim 11 is firmly clamped with a union nut 13 to a retaining body 12. A valve needle 15 is displaceably supported in the nozzle body 10 and cooperates with an inwardly facing valve seat 16 in the nozzle body 10, this seat being preceded by a plurality of injection ports 17. The guide bore 18 of the valve needle 15 is widened, as usual, at one point into a pressure chamber 19, in whose region the valve needle 15 has a pressure shoulder 20 and which communicates via a conduit 22 and a filter body 23 with a connection piece 24 on the retaining body 12 for the connection of a fuel line. The fuel engaging the pressure shoulder 20 of the valve needle 15 displaces the valve needle 15 upward, counter to the graduated course of force of a closing force arrangement described hereinafter; the fuel is ejected in a preinjection phase and a main injection phase through the injection ports 17.

A spring chamber 26 for receiving a closing spring 27 is formed in the retaining body 12; the spring is supported at one end on the bottom of the chamber 26, via a disk 28, and at the other end on a pressure piece 29. The pressure piece

29 rests on a piston 30, which is tightly guided in a cylindrical through bore 31 in the shim 11. The piston 30 passes all the way through the through bore 31 and is supported on the valve needle 15, urging it in the closing direction.

The sides facing one another of the piston 30 and the valve needle 15 together with an enlargement 32 of the guide bore 18 in the nozzle body 10, near the shim 11 and a nearby portion of the face of the shim 11, define a pressure chamber 33. A longitudinal groove 35 in the jacket of the piston 30 intermittently connects this pressure chamber 33 with the spring chamber 26, which is pressure-relieved via a leakage conduit 38 and a connection piece 39. Near the side of the piston 30 defining the pressure chamber 33, the longitudinal groove 35 is limited by a control edge 36, which in the closing position of the valve needle 15 and with the piston 30 supported on the valve needle is spaced apart from the annular edge 37 at the transition from the partial face to the through bore 31 of the shim 11 by a distance $h_v$, which is equivalent to the requisite prestroke of the valve needle 15. Alternatively, instead of a longitudinal groove 35 in the circumference of the piston 30, a flat face made by removal of material, for instance a ground face, may be disposed on the piston 30, which leads into the spring chamber 26 and whose end toward the valve needle 15 forms the control edge 36.

Figure 2:
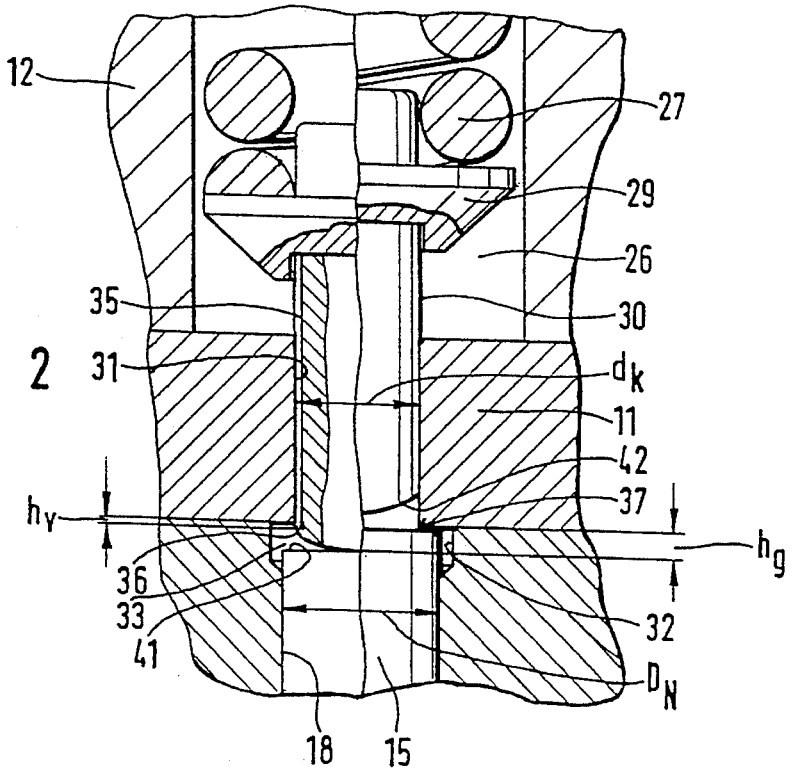
FIG. 2, a detail A of FIG. 1 on a larger scale, in the closing position of the valve needle on the left and the open position of the valve needle on the right, and FIG. 3, an alternative to the exemplary embodiment of FIG. 2, again in the closing position of the valve needle on the left and the open position of the valve needle on the right.
Figure 3:
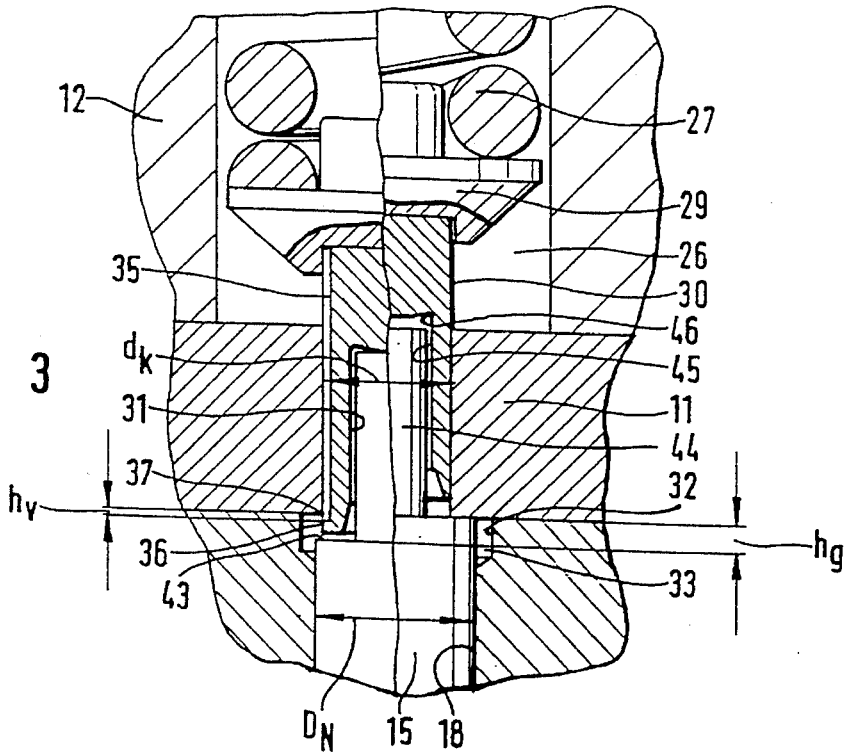

The diameter $d_K$, or the hydraulic effective surface area, of the piston 30 is smaller than the diameter $D_N$ or effective surface area of the valve needle 15. In the exemplary embodiment of FIG. 2, the face end 41 of the valve needle 15 that defines the pressure chamber 33 is embodied as flat, and the opposed face end 42 of the piston 30 is embodied as convex. Alternatively, in the exemplary embodiment of FIG. 3 the valve needle 15, also as usual, has a thrust protrusion 44, set back via a shoulder 43, which protrudes with play into a blind bore 45 of the piston 30 and supports the piston on the bottom 46 of the blind bore 45.

The injection nozzle functions as follows: When fuel is supplied by an injection pump through the conduit 22 to the pressure chamber 19, the valve needle 15, once a predetermined opening pressure is attained, is lifted from the valve seat 16 counter to the action of the closing spring 27, which loads the valve needle 15 indirectly via the piston 30; the injection begins. As the pressure rises, the valve needle 15 lifts farther away from the valve seat 16 and displaces the piston 30, until after a prestroke $h_v$ the control edge 36 of the piston interrupts the communication of the pressure chamber 33 with the spring chamber 26. During this prestroke phase, the valve needle 15, because of its large diameter, positively displaces a larger volume of fuel in the pressure chamber 33 than becomes free from direct displacement of the piston 30, which has a smaller diameter. The differential volume is positively displaced out of the pressure chamber 33 into the pressure-relieved spring chamber 26 through the longitudinal groove 35 in the piston 30. During this prestroke phase, the closing spring 27 is tensed with a force that results from the rising fuel supply pressure combined with the effective surface area of the valve needle 15, not taking friction losses into account. At the end of the prestroke $h_v$, when the control edge 36 of the piston 30 blocks off the pressure chamber 33, a control pressure then builds up in the pressure chamber 33 under the pumping influence of the valve needle 15, which continues to be acted upon by the rising supply pressure; this control pressure acts upon the piston 30. Since the effective surface area on the supply side of the valve needle 15 and the effective surface area on the side defining the pressure chamber 33 are of equal size, this control pressure is essentially equal to the supply pressure. However, beginning with the time when the pressure chamber 33 is blocked off, the volume positively displaced by the valve needle 15 positively displaces the piston 30, which is loaded by the closing spring 26 that has been further prestressed by the prestroke $h_v$. However, since the effective surface area of the piston 30 is smaller than that of the valve needle 15, and thus the force generated by the piston 30 at the ed of the prestroke $h_v$ is less than the force generated by the valve needle 15, which is equal to the closing spring force, the piston 30 remains in contact with the valve needle 15 until such time as the supply pressure, and hence also the control pressure in the pressure chamber 33, have risen so far that the force generated by the piston 30 exceeds the prestressing force of the closing spring 27, achieved at the end of the prestroke, in the prestroke position. During that time, the valve needle 15 also remains in the prestroke position. If the supply pressure and hence the control pressure in the pressure chamber 33 then reach a value based on which the piston 30 is loaded with a force that is equivalent to that of the prestressed closing spring 27 and more, then a hydraulic stroke switchover from the valve needle 15 to the piston 30 ensues, based on which the tensing of the closing spring 27 is now effected by the piston 30. As a function of the difference in diameter of the valve needle 15 and the piston 30, the piston 30, as the pressure rise continues, is displaced by a greater distance than the stroke of the valve needle 15. As a result, the piston 30 lifts away from the face end 41 of the valve needle 15 and continues to move farther and farther away from it until the valve needle 15, with its face end 41 or shoulder 43, after traversing the total stroke $h_g$, strike the shim 11. Since as noted above the effective surface area of the piston 30 is less than that of the valve needle 15, the travel of the piston 30 becomes greater than that of the valve needle 15 once the prestroke $h_v$ has been traversed. The consequence is that at equal spring stiffness, the closing force exerted by the piston 30 upon the valve needle 15 via the hydraulic cushion in the pressure chamber 33 becomes greater; in other words, the characteristic of the injection nozzle described is equivalent to that of a two-spring holder.

I claim:

1. A fuel injection nozzle for internal combustion engines, having a nozzle body in which an inward-opening valve needle is displaceably supported; a (holding) retaining body that supports the nozzle body via a partition, a chamber in said (holding) retaining body for receiving a closing spring that loads the valve needle in a closing direction; a force transmitting device that penetrates the partition and transmits a force of the closing spring to the valve needle, the force transmitting device includes a piston (30) that defines a pressure chamber (33) with a face end (42) toward the valve needle (15) and on another end is loaded by the closing spring (27), whereby the face end (42) forms a hydraulic effective area, which is less than a hydraulic effective surface area of the valve needle, which is formed by a face end (41) of said valve needle remote from a valve seat (16) and said face end of said valve needle (41) also defines said pressure chamber (33); the piston (30) has a control edge (36) that controls a communication with a pressure-relieved side (26) and the pressure chamber (33) in the closing position and during the prestroke of the valve needle (15), during the prestroke the piston (30) is pressed against the valve needle (15) by the force of the closing spring (27), a communication exists between the pressure chamber (33) and the pressure-relieved side (26), and after the prestroke ($h_v$) this communication is interrupted in the remaining stroke of the valve needle (15) and of the piston (30), so that the remaining stroke of the piston (30) takes place by a hydraulic stroke switchover.

2. The fuel injection nozzle of claim 1, in which the partition is formed by a shim (11) fastened between the nozzle body (10) and the retaining body (12); and that the pressure chamber (33) is located in the region of the two end regions of the nozzle body (10) and of the shim (11) that adjoin one another.

3. The fuel injection nozzle of claim 2, in which the pressure chamber (33) is encompassed by an enlargement (32) of a guide bore (18) for the valve needle (15) on the end of the nozzle body (10) near the shim (11).

4. The fuel injection nozzle of claim 3, in which the control edge (36) of the piston (30) is adjoined by a longitudinal groove (35).

5. The fuel injection nozzle of claim 4, in which the piston (30) is embodied as convex on its face end (42) toward the valve needle (15), and the opposed face end (41) of the valve needle (15) is flat.

6. The fuel injection nozzle of claim 4, in which the piston (30) has a blind bore (45), which is engaged by a thrust protrusion (44) of the valve needle (15).

7. The fuel injection nozzle of claim 2, in which the control edge (36) of the piston (30) is adjoined by a longitudinal groove (35).

8. The fuel injection nozzle of claim 7, in which the piston (30) is embodied as convex on its face end (42) toward the valve needle (15), and the opposed face end (41) of the valve needle (15) is flat.

9. The fuel injection nozzle of claim 7, in which the piston (30) has a blind bore (45), which is engaged by a thrust protrusion (44) of the valve needle (15).

10. The fuel injection nozzle of claim 2, in which the control edge (36) of the piston (30) is formed by removal of material from one end of piston (30) and another end of piston (30) leads into the spring chamber (26) of the retaining body (12).

11. The fuel injection nozzle of claim 10, in which the piston (30) is embodied as convex on its face end (42) toward the valve needle (15), and the opposed face end (41) of the valve needle (15) is flat.

12. The fuel injection nozzle of claim 2, in which the piston (30) has a blind bore (45), which is engaged by a thrust protrusion (44) of the valve needle (15).

13. The fuel injection nozzle of claim 3, in which the control edge (36) of the piston (30) is formed by removal of material from one end of piston (30) and another end of piston (30) leads into the spring chamber (26) of the retaining body (12).

14. The fuel injection nozzle of claim 13, in which the piston (30) is embodied as convex on its face end (42) toward the valve needle (15), and the opposed face end (41) of the valve needle (15) is flat.

15. The fuel injection nozzle of claim 1, in which the control edge (36) of the piston (30) is adjoined by a longitudinal groove (35).

16. The fuel injection nozzle of claim 15, in which the piston (30) is embodied as convex on its face end (42) toward the valve needle (15), and the opposed face end (41) of the valve needle (15) is flat.

17. The fuel injection nozzle of claim 15, in which the piston (30) has a blind bore (45), which is engaged by a thrust protrusion (44) of the valve needle (15).

18. The fuel injection nozzle of claim 1, in which the control edge (36) of the piston (30) is formed by removal of material from one end of piston (30) and another end of piston (30) leads into the spring chamber (26) of the retaining body (12).

19. The fuel injection nozzle of claim 18, in which the piston (30) is embodied as convex on its face end (42) toward the valve needle (15), and the opposed face end (41) of the valve needle (15) is flat.

20. The fuel injection nozzle of claim 1, in which the piston (30) has a blind bore (45), which is engaged by a thrust protrusion (44) of the valve needle (15).

* * * * *